United States Patent [19]

Wenstadt et al.

[11] 4,318,699

[45] Mar. 9, 1982

[54] TRIM CONTROL

[75] Inventors: Thomas D. Wenstadt, Oshkosh; Cary J. Chmielewski, North Fond du Lac, both of Wis.

[73] Assignee: Brunswick Corporation, Skokie, Ill.

[21] Appl. No.: 103,454

[22] Filed: Dec. 14, 1979

[51] Int. Cl.[3] ..... B63H 5/12; B63H 21/26

[52] U.S. Cl. ..... 440/1; 114/277; 440/61; 440/84

[58] Field of Search ..... 440/61, 57, 84, 86, 440/1, 53, 58, 59, 60, 62, 63; 114/152, 275, 276, 277, 285, 286, 287

[56] References Cited

U.S. PATENT DOCUMENTS

| | | | |
|---|---|---|---|
| 3,270,699 | 9/1966 | Bush | 114/277 |
| 3,434,449 | 3/1969 | North | 440/61 X |
| 3,468,282 | 9/1969 | Wintercorn | 440/61 X |
| 3,641,965 | 2/1972 | Schmeidel | 440/61 X |
| 3,834,345 | 9/1974 | Hager et al. | 440/57 X |

*Primary Examiner*—Bruce H. Stoner, Jr.

*Attorney, Agent, or Firm*—Andrus, Sceales, Starke & Sawall

[57] ABSTRACT

A sensor (43) responds to the operation of a marine transportation system to sense on-plane and off-plane conditions of a boat (21) to operate a trim control (44) to automatically position a trimmable drive (25) for a desired boating operation. The preferred embodiment senses engine speed while an alternative embodiment senses fluid pressure opposing boat movement. The drive (25) is moved to an auto-out position (34) at high speeds and to a trimmed-in position (33) at lower speeds.

28 Claims, 21 Drawing Figures

FIG. 6
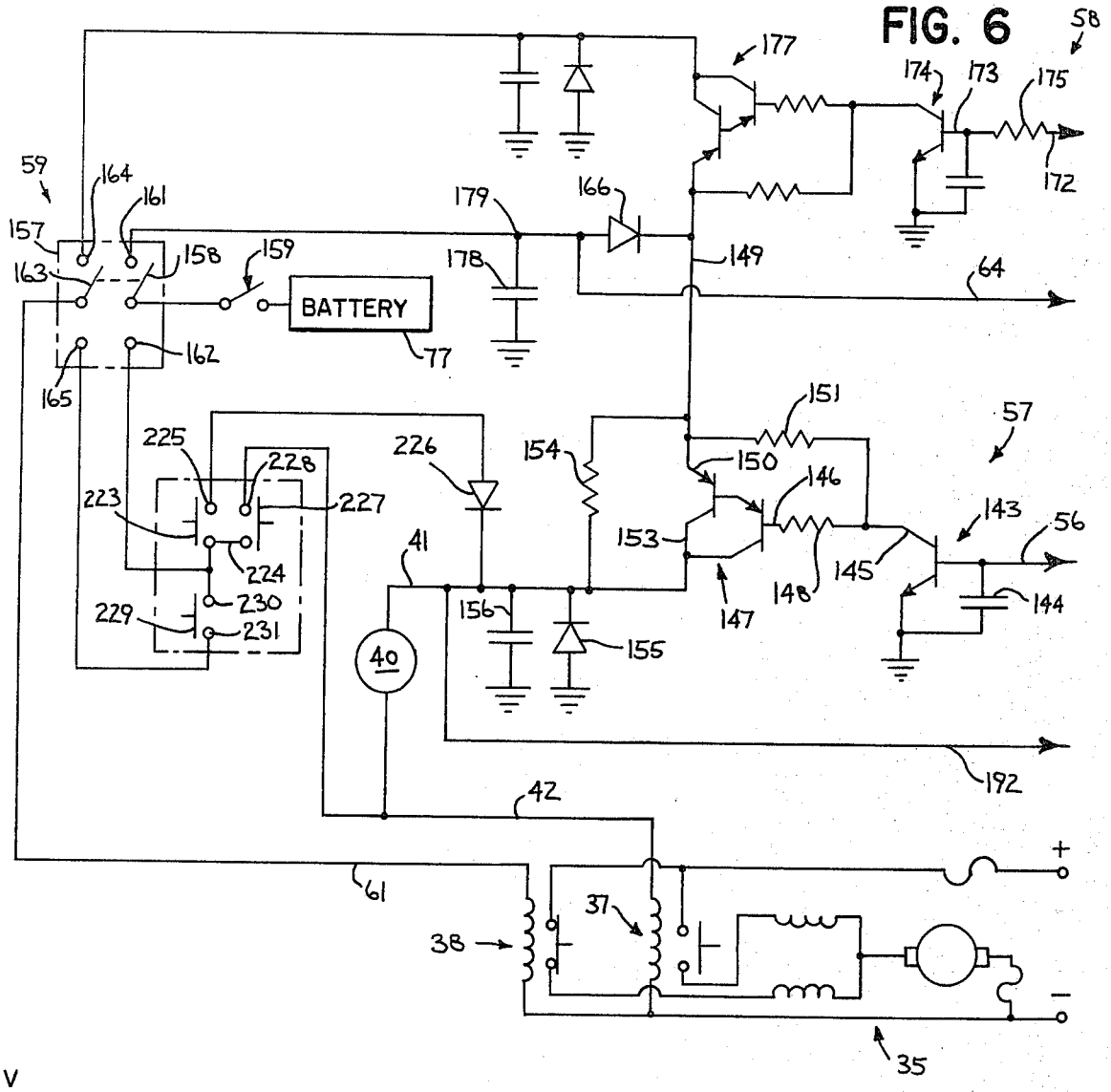
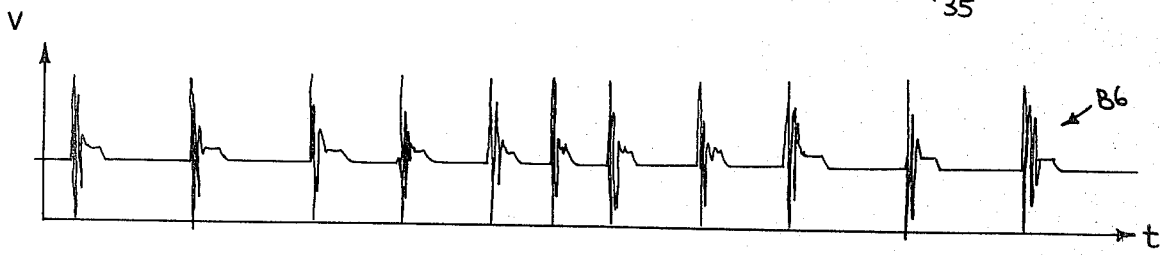
FIG. 7
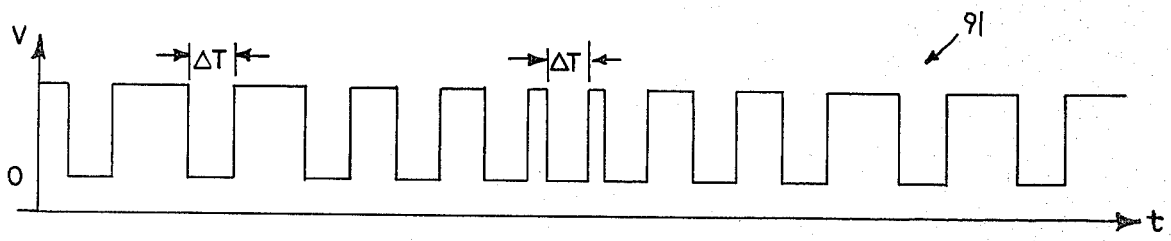
FIG. 8

TRIM CONTROL

DESCRIPTION

Technical Field

The invention relates to a trim control for a marine drive and particularly concerns an automatic trim control.

Background Art

In marine drives such as outboards and stern drives, hydraulic cylinder arrangements, such as disclosed in U.S. Pat. No. 3,434,449 to I. W. North, which is assigned to a common assignee herewith, have been used to trim a drive unit for operation and to tilt the drive unit for beaching or trailering. Control of such systems has been accomplished through manually operated switches to move the drive to a desired trim position. With a manual trim control, the operator must be attentive in order to maintain a proper boat attitude under varied boat loading and speed conditions.

Disclosure of Invention

A trim control responds to the operation of a marine transportation system to sense an off-plane condition and an on-plane condition of the boat to automatically position a trimmable drive for a desired boating operation. The control positions the drive at one or more trim positions in response to one or more sensed operating speeds. The preferred embodiment varies the trim position in response to sensed engine speed while another embodiment varies the trim position in response to sensed fluid pressure opposing boat movement. The control may coordinate or regulate the movement of the drive unit in response to sensed drive unit position and/or sensed speed and/or one or more elapsed time periods. The trim control automatically moves the drive unit of each particular boat to a trim position suitable for that boat in a reliable manner without requiring manual control.

BRIEF DESCRIPTION OF THE DRAWINGS

FIG. 6 is a circuit schematic of a portion of the control of FIGS. 1 and 3;

FIG. 7 is a voltage versus time graph illustrating primary ignition pulses which are used in an internal combustion engine for operating the drive unit of FIGS. 1 and 2;

FIG. 8 is a voltage versus time graph showing a series of pulses produced by the control of FIG. 5 in response to the ignition pulses of FIG. 7;

FIG. 16 is a side elevational view of an operating boat in water and illustrates a low speed operation with the drive unit trimmed-in;

FIG. 18 is a side elevational view of an operating boat in water and illustrates a high speed operation with the drive unit trimmed-in;

BEST MODES FOR CARRYING OUT THE INVENTION

Figures 1, 2, 4:
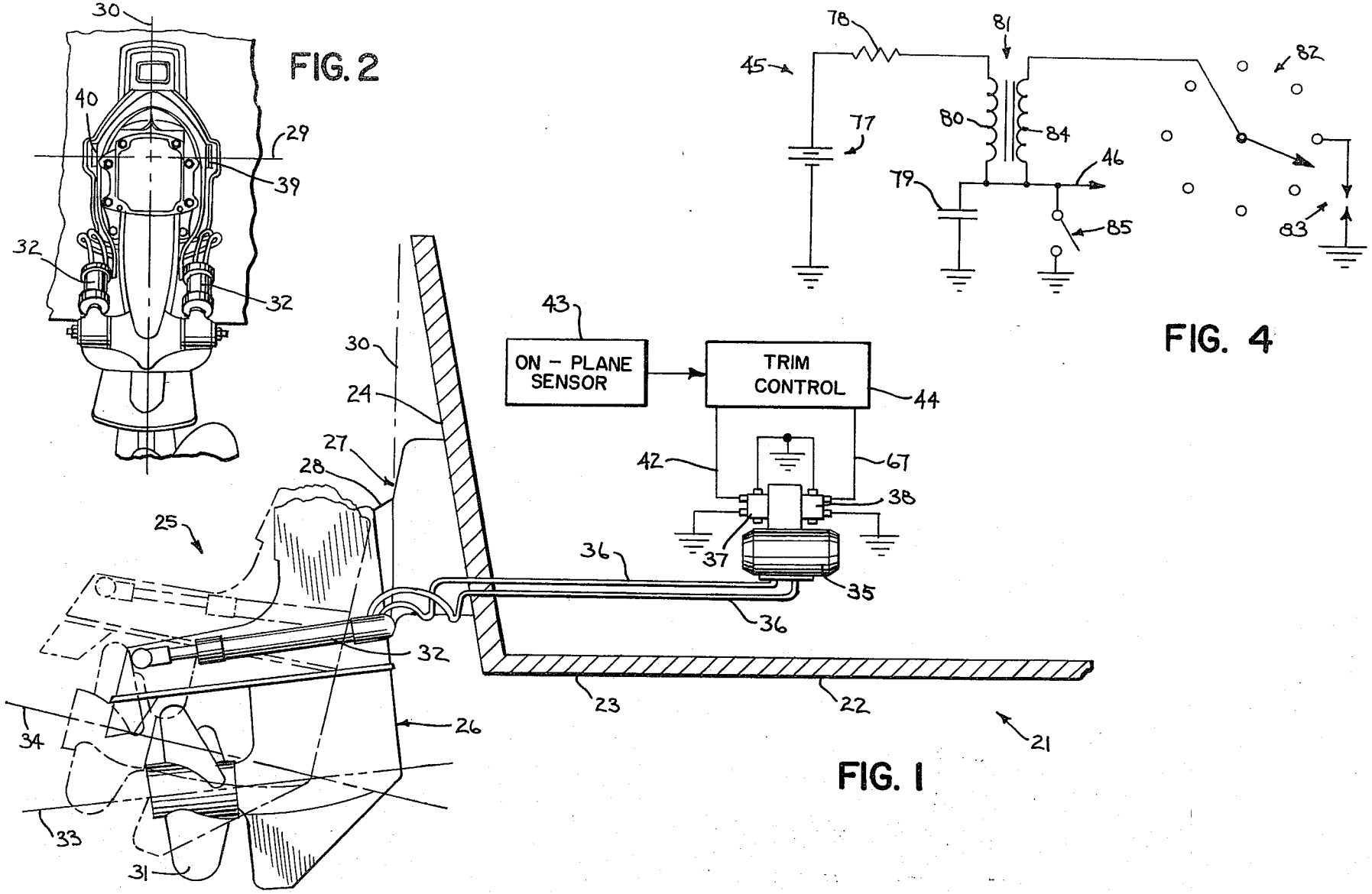
FIG. 1 is an illustration showing a side elevational view of a drive unit mounted on a boat transom having an electrical trim control shown in block diagram.
FIG. 2 is a partial rear view of the drive unit and boat transom of FIG. 1.
FIG. 4 is a circuit schematic of the ignition system of FIG. 3.

A boat 21 provides a hull 22 including a keel 23 and a rearwardly located transom 24. A marine drive 25 includes a drive unit 26 connected to the transom 24 through a mounting assembly 27. The marine unit 25 includes a gimbel ring 28 which pivotally supports the drive unit 26 for rotation about a generally horizontal axis 29 for trimming the boat 21 and for rotation about a generally vertical axis 30 for steering the boat 21.

The drive unit 26 includes a propeller 31 driven by an engine (not shown) which is mounted either internally or externally of the hull 22 and connected through an appropriate drive.

A pair of hydraulic cylinders 32 operate to maintain the drive unit 26 in a pre-selected trim position and to rotate such unit about the horizontal axis 29 to a "trimmed-in" position as shown by thrust axis 33 and an "auto-out" position as shown by the thrust axis 34. With certain boat constructions, the trimmed-in and auto-out axii 33 and 34 are spaced by approximately six to ten degrees. In the preferred embodiment, the selected angular spacing is about eight degrees. The angular spacing is adjustable from about zero to seventeen degrees to permit the desired angular spacing for each particular boat. In addition, the drive unit may be operated manually by disengagement of the auto-trim.

A reversible hydraulic pump 35 is connected to supply operating fluid to and from the pair of hydraulic cylinders 32 through a pair of hydraulic hoses 36. An electrical out-trim relay 37 operates the electrohydraulic pump 35 for moving the drive unit 26 from the trimmed-in thrust axis 33 to the auto-out thrust axis 34 or any selected out-trim position during manual operation. An electrical in-trim relay 38 operates the electrohydraulic pump 35 for moving the drive unit 26 from the auto-out thrust axis 34 to the trimmed-in thrust axis 33 or any selected in-trim position during manual operation.

In some constructions, a trim position sensor 39, which is sometimes referred to as a "trim sender", is mounted upon one side of the gimbel ring 28 and operates to provide an electrical signal which is responsive to the rotative position of the drive unit 26 about the horizontal axis 29.

A limit switch 40 is connected to the gimbel ring 28 and provides an electrical circuit between a pair of connecting leads 41 and 42 while the drive unit 26 is at the trimmed-in thrust axis 33 or between the trimmed-in and auto-out axii 33 and 34. When the drive unit 26 is at or beyond the auto-out thrust axis 34, the limit switch 40 provides an open circuit between the leads 41 and 42.

The construction and operation of the trim sensor 39 and the limit switch 40 is more fully shown in the U.S. Pat. No. 3,641,965 to Schmiedel which issued on Feb. 15, 1972.

In the automatic control mode, the drive-unit 26 is automatically transferred between the trimmed-in thrust axis 33 and the auto-out thrust axis 34 in response to the output of an on-plane sensor 43 as controlled through a trim control 44.

Figure 3:
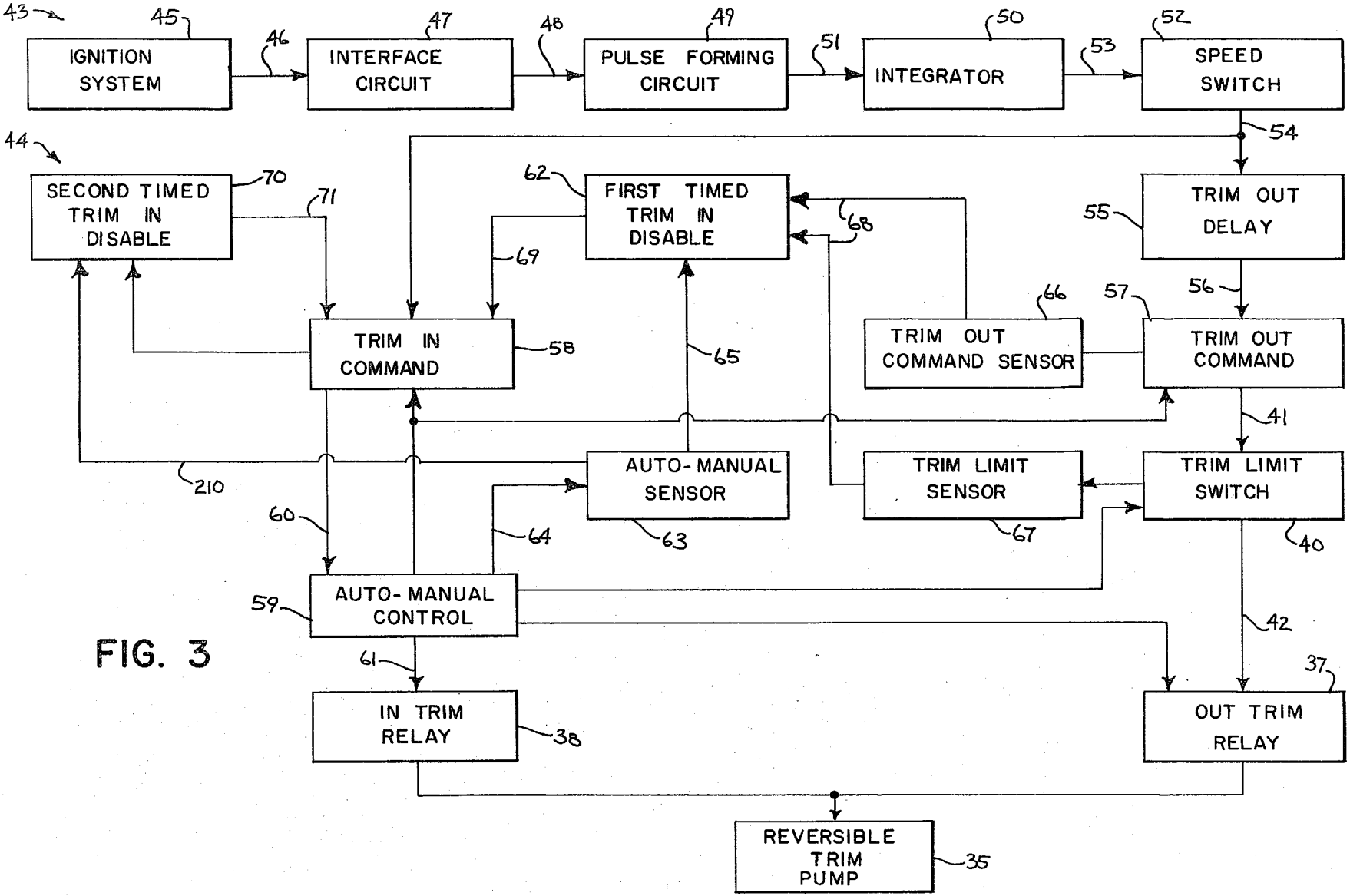
FIG. 3 is a block diagram of the best mode of the speed sensor and trim control of FIG. 1.

With reference to FIG. 3, an ignition system 45 is connected to operate the engine which drives the propeller 31. A signal indicative of the operating speed of the engine is supplied through a lead 46 to an interface circuit 47. A filtered output is supplied through a lead 48 to a pulse forming circuit 49 which, in turn, provides a signal having a constant amplitude and constant pulse width to an integrator 50 through a connecting circuit 51.

A speed switch 52 receives a speed responsive signal from integrator 50 through a connecting circuit 53 and provides a first output at a lead 54 when the engine operates at a low speed up to a first predetermined speed, such as 3100 RPM for example, and provides a second output when the engine operates at a high speed down to a second predetermined speed, such as 2600 RPM for example. The first and second outputs of the speed switch 52 are provided in response to the signal sensed at the ignition system 45 which is indicative of the operating speed of the engine and thus usually of the boat speed.

In a customary automatic operating sequence, the drive unit 26 is maintained at the trimmed-in thrust axis 33 while the boat 21 operates at a low speed between zero RPM and a first predetermined speed, such as 3100 RPM for example. When the boat 21 operates at a high speed which equals or exceeds the first predetermined speed, the speed switch 52 transfers from the first output to the second output in response to the signal sensed at the ignition system 45.

A trim out delay circuit 55 responds to the second output at lead 54 and provides a time delayed output at lead 56. Such delay is established for a predetermined desired time, such as nine seconds for example. A trim out command circuit 57 responds to the time delayed signal at lead 56 and provides a trim out command signal to the out trim relay 37 through the connecting lead 41, trim limit switch 40 and connecting lead 42.

The out trim relay 37 responds to the trim out command signal at lead 41 and operates the reversible trim pump 35 to rotate the drive unit 26 from the trimmed-in thrust axis 33 toward the auto-out thrust axis 34. When the drive unit 26 reaches the auto-out thrust axis 34, the trim limit switch 40 provides an open circuit between connecting leads 41 and 42 to de-energize the out trim relay 37 and the reversible trim pump 35. While in the auto-out condition, the boat 21 operates with the drive unit 26 at the auto-out thrust axis 34 for high speeds.

When the engine operates at or above the first predetermined speed, i.e. 3100 RPM for example, and down to a second predetermined speed, i.e. 2600 RPM for example, the second output of the speed switch 52 also operates as a disable signal to a trim in command 58 which, in turn, maintains the in trim relay 38 disabled by not supplying energizing power through an auto-manual control 59 and connecting circuits 60 and 61. In such manner, the trim in command 58 responds to the second output disable signal from speed switch 52 to prevent the energization of the in trim relay 38 thereby preventing a trimming-in sequence while the boat is operating at a high speed.

The speed of the engine must decrease below the second predetermined speed before automatically transferring to a trimmed-in condition. Thus, when the speed of the engine decreases to or below a second predetermined speed, i.e. 2600 RPM for example, the speed switch 52 responds to the signal sensed at the ignition system 45 and provides the first output for supplying a trim in enable signal to the trim in command 58 and a trim out disable signal to the trim out delay 55. The trim out command 57 responds to the trim out disable signal from speed switch 52 and maintains a trim out disable command signal at lead 41 to insure that the out trim relay 37 is maintained in a de-energized condition under the automatic control sequence.

The trim in command 58 responds to the first output from speed switch 52 and provides an energizing trim in command signal to the in trim relay 38 through the auto-manual control 59. The in trim relay 38 responds to the trim in command signal and transfers the drive unit 26 from the auto-out thrust axis 34 to the trimmed-in thrust axis 33.

The in trim relay 38 is energized to operate the reversible trim pump 35 in a trim in sequence for a predetermined time as determined by a first timed trim in disable circuit 62.

In order to initiate a timing sequence for the trim in operation, the auto-manual control 59 must be conditioned for automatic operation. An auto-manual sensor 63 responds through a circuit 64 to the established automatic operation and supplies an enable signal through a circuit 65 to the timed disable circuit 62. A trim out command sensor 66 functions in conjunction with a trim limit sensor 67 and provides an output through a common circuit 68 to the trim in command 58 through the first timed trim in disable 62.

In order to initiate a timing sequence for the disable circuit 62, the system must be operating under automatic control as sensed by the auto-manual sensor 63, the trim out command must be conditioned to provide a trim out disable signal as sensed by the trim out command sensor 66, and the drive unit 26 must rotate away from the auto-out thrust axis 34 toward the trimmed-in thrust axis as sensed by the trim limit sensor 67.

At the expiration of a first predetermined time, such as eight seconds for example, the first timing circuit 62 supplies an in trim disable signal through a connecting circuit 69. The trim in command 58 responds to the disable signal from the first timing circuit 62 and de-energizes the in trim relay 38 to deactivate the reversible trim pump 35 for terminating the trim in sequence. By the conclusion of the time period provided by the disable circuit 62, the drive unit 26 will have returned to or near the trimmed-in thrust axis 33 for a low speed operation.

A second timed trim in disable circuit 70 responds to the trim in command signal provided by the trim in command 58 and provides a disabling input through a circuit 71 to the trim in command 58 following a second predetermined time, such as 105 seconds for example. Thus if the first timed trim in disable 62 fails to function, the second timed trim in disable 70 will function following a predetermined time period to terminate the trim in command signal and de-energize relay 38 thereby deactivating the pump 35.

FIG. 4 illustrates a conventional ignition system for an internal combustion engine. In this regard, a battery 77 is connected through a ballast resistor 78 to supply energy to the breaker points 85 and condensor 79 through a primary coil 80 of a transformer 81. A conventional distributor 82 is connected to selectively supply energizing pulses to a plurality of spark plugs (not shown) as illustrated at 83 from a secondary coil 84 of transformer 81. The pulses supplied from the primary 80 are monitored through circuit 46 and supplied to the interface circuit 47. At slow speed, a fewer number of pulses per unit time are produced while as speed increases, more ignition pulses per unit time are provided.

Thus under one possible sequence of operation, the circuit 46 could supply a wave form 86 as illustrated in FIG. 7 representing a series of ignition pulses which vary in frequency depending upon the operating speed of the engine.

The pulses of waveform 86 are supplied to a Zenier diode 87 through a forward conducting diode 88 and a series connected resistor 89. The juncture between diode 88 and resistor 89 is connected to the system neutral or ground through a filtering capacitor 90. The interface circuit 47 which includes a diode 98, operates to conduct pulses to connecting circuit 48 which exceed the Zenier voltage $V_Z$ of diode 87. The interface circuit 47 provides excellent noise immunity and isolates inconsistent and/or erratic signals which are below the Zenier voltage $V_Z$.

The pulse forming circuit 49 provides a constant magnitude pulse of a predetermined fixed pulse width at output circuit 51 in response to each pulse of waveform 86 sensed at the connecting circuit 48, as illustrated by waveform 91 in FIG. 8.

The pulse forming circuit 49 employs a pair of voltage comparators 92 and 93 which function to provide the constant magnitude and constant pulse-width pulses in waveform 91. The comparator 92 includes an inverting input 94 connected to the connecting circuit 48 while an output 95 is connected to the connecting circuit 51 and resistor 97 to $V_{cc}$. A reference voltage $V_{cc}$ is supplied at terminal 100 from a reference voltage source 101 and is connected to resistors 97 and 99 and diode 98. The output 95 of comparator 92 is connected to a non-inverting input 102 of comparator 92 through a series connected circuit including a resistor 103 and diode 104. An inverting input 105 of comparator 93 is connected to the output 95 of comparator 92. An output 106 of comparator 93 is connected to a timing capacitor 107 and to the reference voltage $V_{cc}$ through a resistor 108. The output 106 is also connected to the non-inverting input 102 of comparator 92 through a connecting resistor 109. A non-inverting input 110 of comparator 93 is connected to a reference voltage divider 111 including resistors 112 and 113. The inverting input 94 of comparator 92 is also connected to the system neutral or ground through a resistor 94*a*.

When the magnitude of an incoming pulse of waveform 86 exceeds the Zenier voltage $V_Z$ of diode 87, a positive input signal appears at the inverting input 94 of comparator 92. With the sensed pulse at input 94, comparator 92 turns on to switch the output at lead 95 from a logic "1" voltage level to a logic "0" voltage level. The logic "1" and logic "0" levels are at different voltages which are selected according to circuit construction preferences. For example, the logic "1" level could be a positive voltage level, such as a positive eight volts for example, and the logic "0" level could constitute the system ground or a few positive milli-volts for example. Other voltage levels could be used if desired according to circuit construction preferences.

With output 95 at logic "0" in response to a sensed pulse at input 94, the diode 104 is reverse biased and eliminates the positive feedback to input 102 of comparator 92. The logic "0" signal also appears at input 105 of comparator 93 which "turns off" to provide a high impedance at output 106. The timing capacitor 107 begins to charge through resistor 108 and provides an increased voltage level at input 102. When capacitor 107 reaches a predetermined voltage level set by resistors 99 and 94*a*, the comparator 92 "turns off" to provide a logic "1" signal at output 95 at a predetermined time following the initial receipt of the incoming pulse at input 94. When comparator 92 turns off, comparator 93 turns on to discharge capacitor 107 and resets the circuit for another timing operation for the next incoming pulse. The output of comparator 92 thus provides a square wave voltage signal for each pulse having a fixed predetermined magnitude and a constant pulse width as illustrated by waveform 91 in FIG. 8. The number of pulses per unit time at output 95 and connecting circuit 51 vary in accordance with the engine speed so that an increased engine speed will produce a greater number of pulses per unit time and vice versa.

The integrator 50 includes a pair of RC integrating circuits including resistors 114 and 115 and capacitors 116 and 117. With the engine turned off, the comparator 92 is "turned off" and a logic "1" signal is provided through connecting circuit 51 to integrator 50. The capacitors 116 and 117 become charged to provide a Vmax signal at an inverting input 118 of a differential comparator 119 through a resistor 120.

The differential voltage comparator 119 functions as a speed switch 52 and includes a non-inverting input 121 connected to an output 122 through a feed-back circuit including resistors 123 and 124 and a diode 125. The non-inverting input 121 is also connected to receive the reference voltage $V_{cc}$ through a voltage divider network including resistors 126, 127 and 128. A capacitor 129 is connected between the inputs 118 and 121 to provide noise immunity for the comparator 119.

Figure 9:
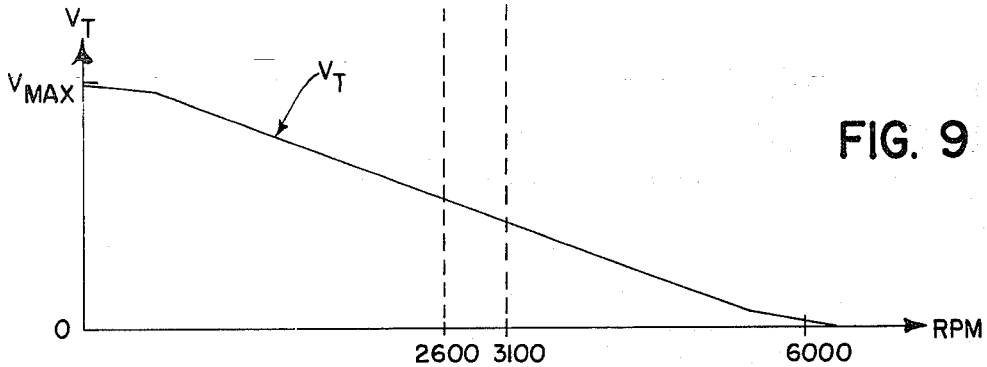
FIG. 9 is a voltage versus RPM graph illustrating a speed responsive input to the speed responsive switch of FIG. 5 for one possible sequence of operation.
Figure 10:
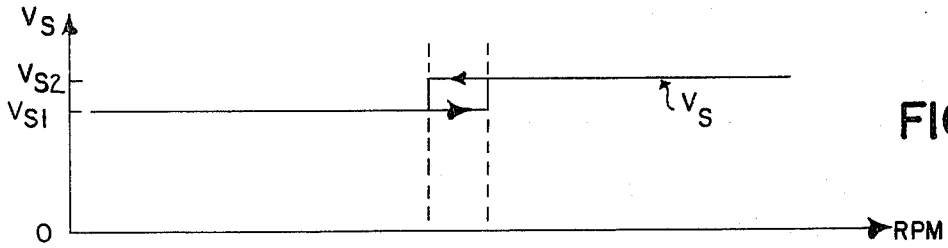
FIG. 10 is a voltage versus RPM graph showing a reference input to the speed responsive switch of FIG. 5 for one possible sequence of operation.

When the boat 21 is at standstill and the engine is turned off, the constant positive voltage Vmax remains at input 118 while a reference voltage $V_{s1}$ of lesser magnitude appears at input 121 as illustrated at zero RPM in FIGS. 9 and 10. Under such standstill condition, the comparator 119 remains "turned on" and provides a logic "0" trim command signal at output 122 and connecting circuit 54 as illustrated in FIG. 11.

Assuming that the boat 21 is constantly accelerated to higher speeds with a corresponding increase in revolutions per minute (RPM), the number of pulses per unit time correspondingly increases. As the speed of boat 21 increases, the DC signal $V_t$ at input 118 decreases and is continuously compared with the reference signal $V_s$ at input 121 which is established at the magnitude of $V_{s1}$ during low speeds.

Figure 11:
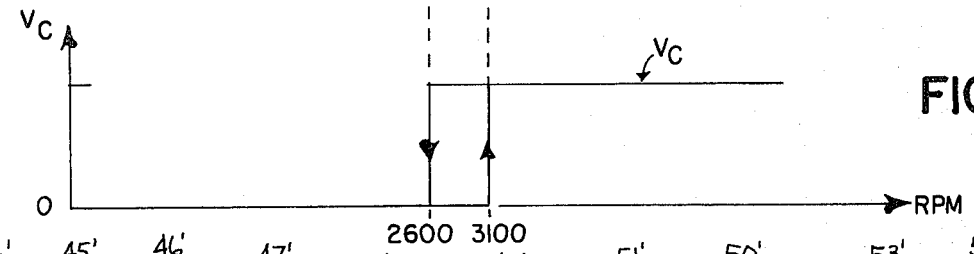
FIG. 11 is a voltage versus RPM graph showing a trim command signal provided by the speed responsive switch of FIG. 5 in response to the wave form inputs of FIGS. 9 and 10.

When the engine speed of boat 21 increases to a first predetermined magnitude, such as 3100 RPM for example, the magnitude of the speed responsive signal $V_t$ becomes sufficiently decreased relative to the reference voltage $V_{s1}$ to "turn off" comparator 119 and provide a logic "1" trim command signal at output 122 and connecting circuit 54 as illustrated in FIG. 11. With a logic "1" signal at output 122, the diode 125 becomes reverse biased, resulting in an increased reference voltage $V_{s2}$ appearing at input 121 of comparator 119.

When the boat 21 is accelerated from a higher to a lower speed, the engine speed will likewise decrease and a fewer number of pulses of wave form 86 appear for each time unit and the speed responsive signal $V_t$ correspondingly increases. When the engine speed decreases to a second predetermined magnitude, such as 2600 RPM for example, the speed responsive signal $V_t$ correspondingly increases and becomes sufficiently increased relative to the reference voltage $V_{s2}$ to turn on comparator 119 and provide a logic "0" trim command signal at output 122 and connecting circuit 54 as illustrated in FIG. 11. When the trim command signal $V_c$ returns to logic "0" as the engine speed decreases to the second predetermined magnitude, such as 2600 RPM for example, the diode 125 no longer is reverse biased and the reference signal $V_s$ changes to the magnitude $V_{s1}$ at the input 121 of comparator 119.

The transfer of the trim command signal $V_c$ at output 122 and connecting circuit 54 to the logic "1" provides a trim out enable signal to the delay circuit 55 and a trim in disable signal to the trim in command 58.

The trim out delay circuit 55 includes a voltage comparator 130 having a non-inverting input 131 connected to the connecting circuit 54 through a diode 132 and a resistor 133. The input 131 is also connected to the system neutral of ground through a capacitor 134 and to the reference voltage $V_{cc}$ through a resistor 135. An inverting input 136 of comparator 130 is connected to the reference voltage $V_{cc}$ through a voltage dividing circuit including resistors 137 and 138. An output 139 of comparator 130 is connected to the connecting circuit 56 through a resistor 140. The output 139 is also connected to the reference voltage $V_{cc}$ through a resistor 141 and to the system neutral or ground through a capacitor 142.

When boat 21 is operating at a low speed and comparator 119 provides a logic "0" signal through the connecting circuit 54, the comparator 130 is turned on to provide a logic "0" signal at connecting circuit 56. When the boat 21 operates at a higher speed and comparator 119 provides a logic "1" output at connecting circuit 54, the diode 132 becomes reverse biased and capacitor 134 is allowed to charge through the resistor 135. When capacitor 134 becomes charged to a predetermined magnitude, the comparator 130 turns off and provides a logic "1" signal at the connecting circuit 56 which is supplied to the trim out command circuit 57. The stabilizing capacitor 142 reduces or eliminates oscillations which might otherwise occur. The trim out delay 55 can be constructed to provide a preselected delay, such as between eight to ten seconds for example.

A base circuit of an NPN switching transistor 143 is connected to the circuit 56 while its emitter circuit is connected to the system neutral or ground. A bypass capacitor 144 is connected between the base and emitter circuits of transistor 143. A collector circuit 145 of transistor 143 is connected to a base circuit 146 of a Darlington transistor 147 through a resistor 148. An operating power lead 149 is connected to an emitter circuit 150 of the Darlington 147 and to the collector circuit 145 of transistor 143 through a resistor 151.

A resistor 154 connects the power lead 149 with the lead 41. A diode 155 and capacitor 156 are parallel connected between the collector 153 and the system neutral or ground for clamping voltage transients and filtering high frequencey signals.

The auto-manual control 59 includes a double pole, double throw mode switch 157 which includes a movable contact arm 158 which is connected through a key operated switch 159 to the battery 77. The movable arm 158 may be selectively positioned for electrical contact with a contact 161 for automatic operation or with a contact 162 for manual operation. A movable arm 163 may be selectively positioned for electrical contact with a contact 164 for automatic operation or with a contact 165 for manual operation. The movable arms 158 and 163 are ganged for simultaneous operation.

With key switch 159 closed, battery power in conducted through switch 159, arm 158, contact 161 and through diode 166 to the power circuit 149 and thus to the Darlington 147. When a logic "1" signal is supplied to the trim out command 57 as supplied through the connecting circuit 56, the switching transistor 143 and Darlington 147 are rendered conductive to supply energizing power from battery 77 through the diode 166, Darlington 147, connecting circuit 41, the closed contacts of the trim limit switch 40, and the connecting circuit 42 for energizing the out-trim relay 37. When the drive unit 26 rotates to or beyond the auto-out thrust axis 34, the trim limit switch 40 provides an open circuit to thereby de-energize the out-trim relay 37 which de-energizes the reversible trim pump 35. The trimming-out sequence thus terminates and the drive unit 26 remains at or near the auto-out thrust axis 34 for a high speed operation.

When the speed of boat 21 decreases to a low speed, the comparator 119 provides a logic "0" output at the connecting circuit 54 which is supplied to an inverting input 167 of a comparator 168 through a connecting resistor 169. A non-inverting input 170 of comparator 168 is connected to the reference voltage $V_{cc}$ through the voltage divider 111. The logic "0" at input 167 turns off comparator 168 which, in turn, provides a logic "1" signal at output 171. The logic "1" signal at output 171 provides an enable signal through a connecting circuit 172 to a base circuit 173 of a NPN switching transistor 174 through a connecting resistor 175. The connecting circuit 172 is also connected to the reference voltage $V_{cc}$ through a resistor 176. The switching transistor 174 functions in an identical manner as the switching transistor 143. Thus a logic "1" appearing at base circuit 173 turns transistor 174 on and, in turn, renders a Darlington transistor 177 conductive to provide a power conducting path from battery 77 through the diode 166, power conducting circuit 149, Darlington 177, switch contact 164, movable arm 163, and connecting circuit 61 to energize the in trim relay 38. The reversible trim pump 35 is thereby energized to move the drive unit 26 toward the trimmed-in thrust axis 33. The Darlington circuit 177 and associated inter-connected circuit operates in an identical manner as discussed with respect to the Darlington 147 and associated circuitry.

A bypass capacitor 178 is connected to a connecting circuit 179 with the contact 161 and diode 166. The connecting circuit 64 is connected to circuit 179 for providing a signal indicative of whether the system is operating either manually or automatically. With switch arm 158 engaging contact 161, a logic "1" signal is supplied through the connecting circuit 64 to a base circuit 180 of an NPN switching transistor 181 through a connecting resistor 182. The base circuit 180 is connected to the system ground or neutral through a resistor 183 while a bypass capacitor 184 joins the base circuit 180 and an emitter circuit 185 of transistor 181. A collector circuit 186 of transistor 181 is connected to an inverting input 187 of a comparator 188 through a resistor 189. The input 187 is also connected to the reference voltage $V_{cc}$ through a resistor 190. A non-inverting input 191 of comparator 188 is connected to the voltage divider 111.

Under automatic operation, a logic "1" appears at base 180 to turn on transistor 181 which in turn renders the comparator 188 turned off and sets a voltage reference on an inverting input 210 of a comparator 207. As a result, comparator 188 provides a high impedance at the connecting circuit 65 signifying that the first timed trim-in disable circuit 62 is conditioned for automatic operation and, by conditioning comparator 207, the second timed trim-in disable circuit 70 is set for automatic operation.

The trim out command sensor 66 and the trim limit sensor 67 function as a common circuit having a common input 192 which is connected to the trim limit switch 40 through the connecting lead 41 and connected to the resistor 154 and the collector circuit 153 of Darlington 147. A base circuit 193 of a switching transistor 194 is connected to the connecting lead 192 through a resistor 195 and is connected to the system neutral or ground through a resistor 196. The base circuit 193 is bypassed to the emitter circuit through a capacitor 197.

The connecting circuit 68 of the common sensors 66 and 67 and the connecting circuit 65 are mutually connected to first timed trim in disable circuit 62 and to a common resistor 198. A timing capacitor 199 is connected to resistor 198 and also to the reference voltage $V_{cc}$ through a resistor 200. The timing capacitor 199 is also connected to an inverting input 201 of a comparator 202. A non-inverting input 203 of comparator 202 is connected to the system neutral or ground through a resistor 204 and is also connected to the reference voltage $V_{cc}$ through a resistor 205. The output circuit 69 of comparator 202 is coupled to its input 203 through a feedback resistor 206.

With the system operating in an automatic mode sequence, switch arm 158 is electrically connected with contact 161 so that transistor 181 is turned on and comparator 188 turned off to provide a high impedance at output 65. With boat 21 operating at a high speed, the trim out command 57 provides a trim out command signal at the connecting circuit 41 in that the Darlington 147 is turned-on in response to the second output of the speed switch 52. Such trim out command signal is sensed through lead 192 which renders transistor 194 turned on. In that the drive unit 26 is at or beyond the auto-out thrust axis 34 in a high speed operation, the contacts of the trim limit switch 40 are open which effectively supplies a logic "1" to sensing circuit 192, and resistor 195 to maintain the transistor 194 turned on.

With transistor 194 in a turned-on condition in a high speed automatic operation, the timing capacitor 199 is maintained in a fully discharge condition through resistor 198.

When the speed switch 52 senses a low speed operation, a trim out disable signal is provided to the trim out command 57 through the trim out delay 55. In such case, the Darlington 147 is switched off. At the same time, a trim in enable signal is supplied to the trim in command 58 which functions to operate the reversible trim pump 35 in a trimming-in operation as previously described. When the drive unit 26 departs from the auto-out thrust axis 34 when moving toward the trim in thrust axis 33, the trim limit switch 40 closes its contacts to provide a low potential or logic "0" signal to the sensing lead 192 which turns off transistor 194. The capacitor 199 thus charges through the resistor 200. When capacitor 199 has charged for a predetermined time, the signal existing at input 201 of comparator 202 increases to a voltage reference set by resistors 204, 205 and 206 thereby turning comparator 202 on. A logic "0" output is thereby provided at output circuit 69 of comparator 202 in response to the timed charge of capacitor 199 which operatively de-energizes the in trim relay 38 but turning off the switching transistor 174 and Darlington 177. The timed charge of capacitor 199 is pre-established to enable sufficient time for the drive unit 26 to reach the trimmed-in thrust axis 33. For example, an eight second timing period could be established for the first timed trim in disable 62. In such situation, the drive unit 26 returns to the trim in thrust axis 33 well before the expiration of such timing period.

The second timed trim in disable 70 includes a comparator 207 having a non-inverting input 208 connected to the output 171 of comparator 168 to a resistor 209. An inverting input 210 of comparator 207 is connected to the reference established by resistors 189, 190, and transistor 181. The input 208 is also connected to the system neutral or ground through a resistor 211. An output 212 of comparator 207 is connected to a timing capacitor 213 to a resistor 214 and to a non-inverting input 215 of a comparator 216. The input 215 is also connected to the timing capacitor 213 and to the reference voltage $V_{cc}$ through a resistor 217. An inverting input 218 of comparator 216 is connected to the reference voltage $V_{cc}$ through the resistors 204, 205 and 206 while an output 219 is connected to the reference voltage $V_{cc}$ through a resistor 220. The output 219 of comparator 216 is connected to the inverting input 167 of comparator 168 through a resistor 221. The output 219 of comparator 216 is also connected to the non-inverting input 208 of comparator 207 through a resistor 222.

When initiating an in trim operation, comparator 168 turns off thus providing a logic "1" output to the switching transistor 174 through the connecting circuit 172. Such logic "1" signal will also be supplied to the input 208 to turn off comparator 207 and provide a logic "1" signal at output 212 to permit capacitor 213 to charge through resistor 217. In a normal operation, either comparator 168 will turn on in response to a high-speed operation as commanded by the speed switch 52 or comparator 202 will turn on in response to a signal from the first timed trim in disable circuit 62. In either case, a logic "0" signal will be supplied to input 208 and comparator 207 will turn-on to provide a logic "0" at output 212 to thereby discharge the capacitor 213.

In the event that the first timed trim in disabled circuit 62 fails to de-activate the trimming-in operation, capacitor 213 will charge to a pre-determined level after a second pre-determined time. At the expiration of such timing sequence, comparator 216 turns off to provide a logic "1" signal at output 219 which is supplied to inputs 167 and 208. The comparator 168 turns on to provide a logic "0" disable signal at output 171 which is supplied to turn off the switching transistor 174 and Darlington 177 through the connecting circuit 172. Comparator 207 will remain turned off until transistor 181 indicates manual operation. In such manner, the in trim relay 38 is de-energized to terminate the in trimming sequence after the second pre-determined time in the event that such sequence is not terminated sooner.

For manual control, the switch 157 provided by the auto-manual control 59 is operated so that switch arms 158 and 163 are removed from contacts 161 and 164, respectively, and connected to contacts 162 and 165, respectively. If a manual trimming-out sequence is desired, a switch 223 is manually actuated to complete a circuit from battery 77 through the closed key switch 159, switch arm 158, contact 162, a contact 224, the switch 223, a contact 225, a diode 226, and the trim-limit switch 40 which is connected to the out-trim relay 37 through the connecting circuit 42. In.a situation where the drive unit 26 is desired to be rotated outward and upward beyond the auto-out thrust axis 34, such as in a trailering position for example, a manually operable switch 227 is actuated to connect the contact 224 with a contact 228 for supplying energizing power directly to the out-trim relay 37 through the connecting circuit 42 thereby bypassing the trim limit switch 40.

For a manual in trim operation, a switcharm 229 is manually actuated to complete a circuit through contacts 230 and 231 and provide an energizing circuit from battery 77, the close key switch 159, switch arm 158, contact 162, contact 230, switch 229, contact 231, contact 165, and switch arm 163 to supply energy to the in trim relay 38 through the connecting circuit 61.

When connected for a manual operation, the contact 161 is open circuited and a logic "0" signal is supplied through connecting circuit 64 to turn off transistor 181 and turn-on comparator 188 and comparator 207. A logic "0" signal will appear at outputs 65 and 212 and capacitors 199 and 213 will discharge. Furthermore, operating power is disconnected from the common power source lead 149 to thereby de-activate the Darlington transistors 147 and 177 so that the automatic control is disabled from controlling the energization of either the out trim relay 37 or the in trim relay 38.

The regulated DC voltage $V_{cc}$ at terminal 100 is obtained from battery 77 through a regulator 234, the diode 233, and a resistor capacitor network 235.

Figure 5:
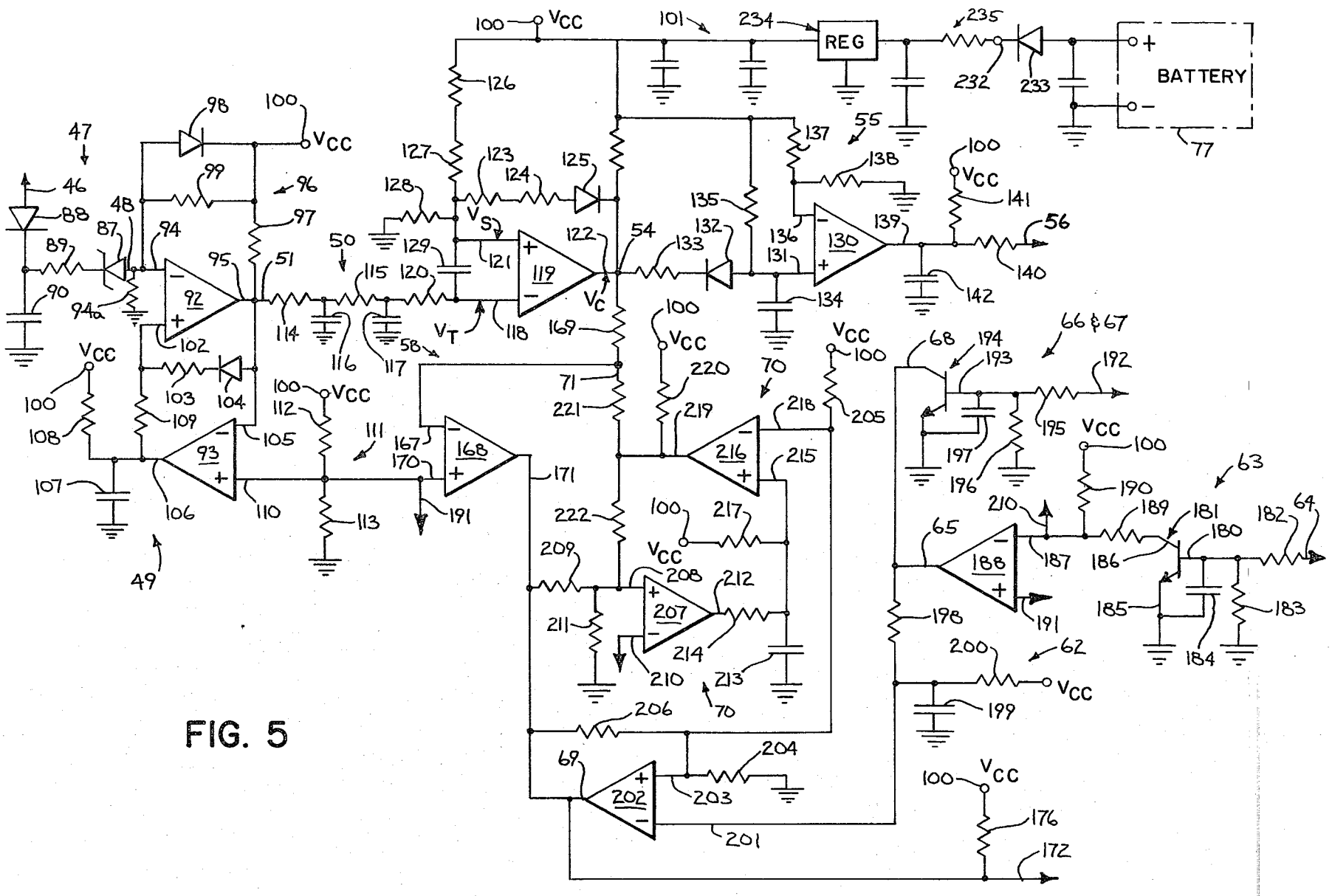
FIG. 5 is a circuit schematic of a portion of the control of FIGS. 1 and 3.
Figure 12:
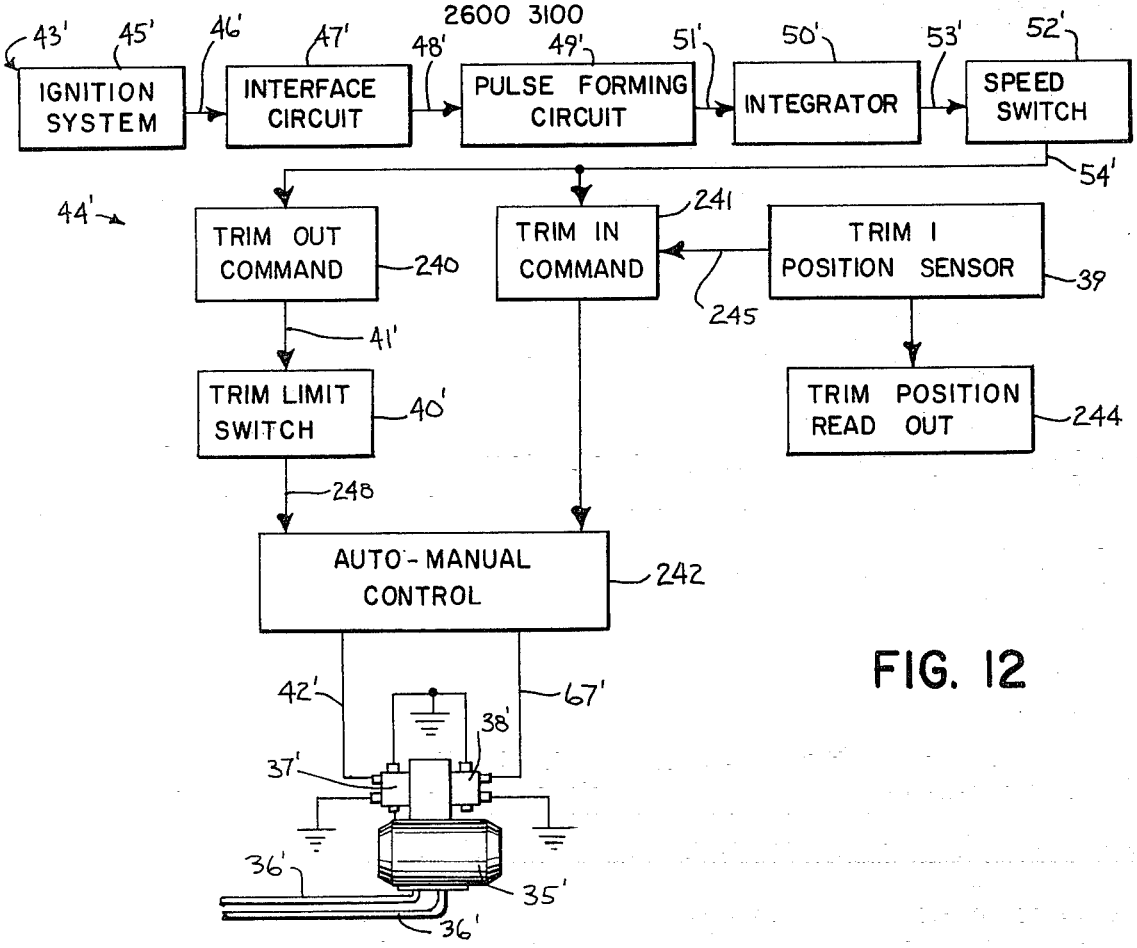
FIG. 12 is a block diagram illustrating an alternative embodiment of the trim control of FIG. 1.
Figure 13:
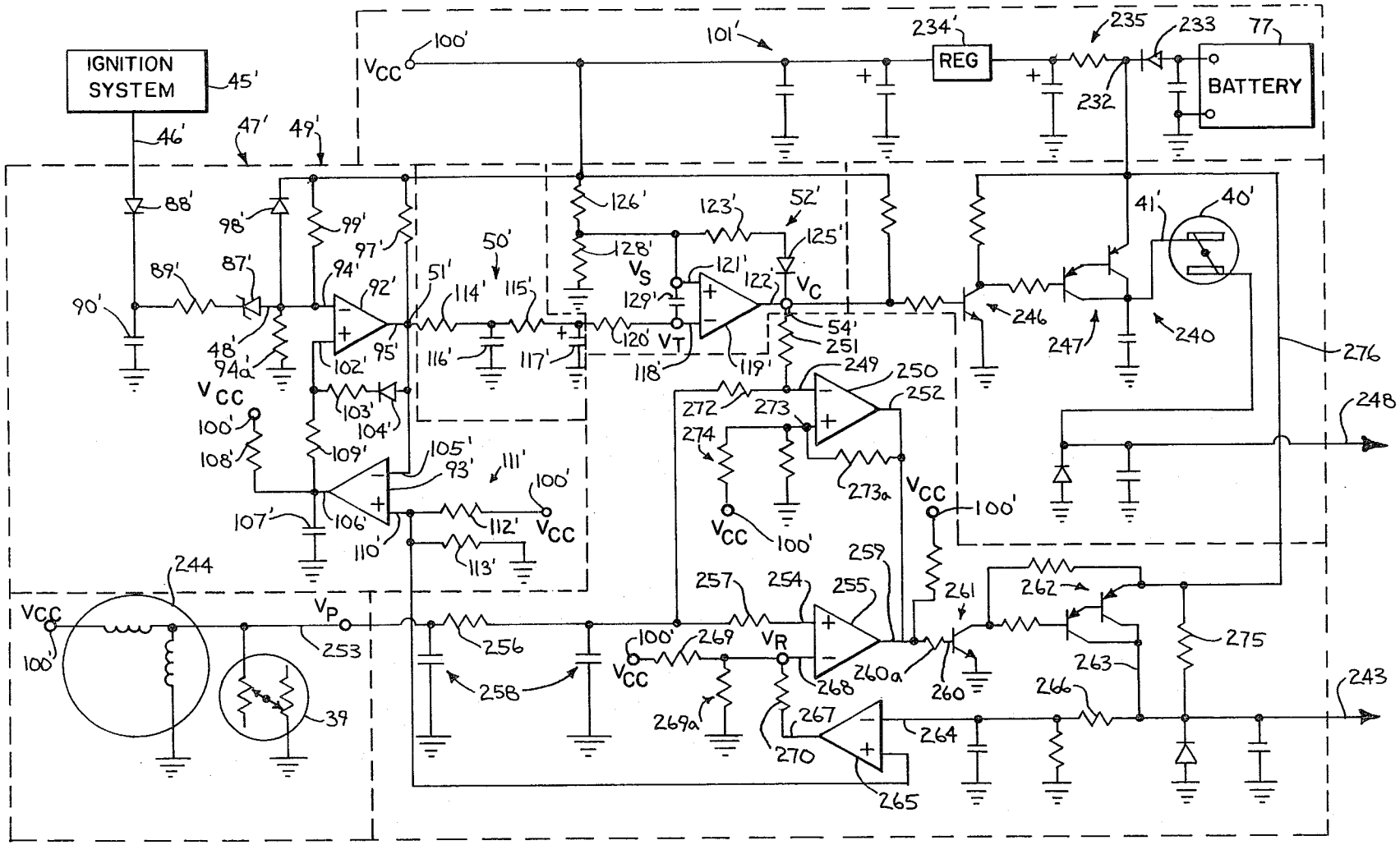
FIG. 13 is a circuit schematic of the control of FIG. 12.

An alternative embodiment is disclosed in FIGS. 12 and 13 which employs the same on-plane sensor 43 as previously discussed with respect to FIGS. 3 and 5. In that an identical or substantially similar construction and operation for the on-plane sensor 43 and some other elements is provided in both embodiments, the similar or identical components in FIGS. 12 and 13 have been identified with identical numbers primed and further discussion thereof is deemed unnecessary.

As in the embodiment of FIGS. 3–6, a high speed operation is sensed by speed switch 52' to provide a second output which constitutes an enable signal to a trim out command circuit 240 and a disable signal to a trim in command circuit 241. When the boat 21' is operated at a low speed, the speed switch 52' provides a first output which constitutes an enable signal to the trim in command circuit 241 and a disable signal to the trim out command circuit 240.

In transferring to the high-speed operation, the trim out command 240 provides a trim out command signal to energize the out-trim relay 37' through the trim limit switch 40', an auto-manual control circuit 242 and a connecting lead 42'. When transferring to a lower speed, the first output of the speed switch 52' actuates the trim in command 241 to provide a trim in command signal through a connecting circuit 67' to energize the in trim relay 38'. The auto-manual control 242 may be constructed and operated substantially as the auto-manual control 59.

In an out trimming sequence, the drive unit 26' is rotated until reaching the auto-out thrust axis 34' where the trim-limit switch 40' open circuits to de-energize the out trim relay 37'. When in an in-trimming sequence, the actual position of the drive unit 26' is continuously monitored by the trim position sensor 39, sometimes referred to as a "trim sender". A trim position readout 244 is connected to sensor 39 and provides a visual readout indicating the actual position of the drive unit 26'. The sensor 39 further provides a trim position signal through a connecting circuit 245 which is used by the trim in command 241 to terminate an in trimming sequence.

With specific reference to FIG. 13, the trim out command 240 includes an switching transistor 246 cascaded with a Darlington transistor 247, the latter connected to the trim limit switch 40' through a connecting circuit 41'. During low speed, the switching transistors 246 and 247 remain turned off so that the out trim relay 37' remains in a deactivated condition.

When the boat 21' operates to a high speed, comparator 119' turns off to provide a second output, namely a logic "1" trim out enable signal, which turns on the transistor switches 246 and 247 to provide energizing power to the out trim relay 37' through the connecting circuit 41', trim limit switch 40', a connecting circuit 248, the auto-manual control 242 and connecting circuit 42'. When the drive unit 26' arrives at the auto-out thrust axis 34', the limit switch 40' opens its contacts and de-energizes the out trim relay 37' to maintain the drive unit 26' at or slightly beyond the auto-out thrust axis 34'. The limit switch 40' remains in the open circuit condition until the drive unit 26' is lowered from the auto-out thrust axis 34'.

When the boat 21' decreases in speed, the speed switch 52' provides the first output, namely a logic "0" signal, to enable the trim in command circuit 241 and disable the trim out command circuit 240. The disable logic "0" turns-off transistors 246 and 247 to maintain the out trim relay 37' in a de-energized condition.

The logic "0" in trim enable signal from speed switch 52' is supplied to an inverting input 249 of a voltage comparator 250 through a resistor 251. The comparator 250 turns off in response to the trim in enable signal and provides a logic "1" at an output 252.

The trim position sensor 39, which constitutes a variable potentiometer having one terminal connected to the system ground, is connected to an input circuit 253 for providing a trim position signal $V_p$. The sensor 39 is also connected to the trim position readout 244 for continuously monitoring the trim position.

The trim position signal $V_p$ at input 253 is connected to a non-inverting input 254 of a voltage comparator 255 through a pair of series connected resistors 256 and 257. A pair of parallel connected capacitors 258 are connected to resistors 256 and 257 to eliminate transients. When at the auto-out thrust axis 34', the trim position signal $V_p$ at input 254 increases to a level for maintaining the comparator 255 in a turned-off condition for providing a logic "1" at an output 259. The output circuits 252 and 259 of the comparators 250 and 255, respectively, are commonly joined to a base circuit 260 of a switching transistor 261 through an input resistor 260*a*. The switching transistor 261 is cascaded to a Darlington transistor 262 which provides a collector circuit 263 connected to the coupling circuit 243 and thus to the in trim relay 38' through the auto-manual control 242.

With logic "1" signals appearing at the outputs 252 and 259 of comparators 250 and 255, the switching transistors 261 and 262 turn-on and provide a logic "1" energizing signal to the connecting circuit 243 which functions in an automatic sequence to supply energizing power for energizing the in trim relay 38'. The drive unit 26' thus rotates from the auto-out thrust axis 34' toward the trimmed-in thrust axis 33' and the trim position signal $V_p$ correspondingly decreases toward a logic "0" level.

When in an in trimming operation, the logic "1" signal at output 263 of Darlington 262 is also applied to an inverting input 264 of a differential voltage comparator 265 through a resistor 266. With the logic "1" signal appearing at input 264, the comparator 265 turns-on and provides a logic "0" signal at an output 267. An inverting input 268 of comparator 255 is connected to the reference voltage $V_{cc}$ through a resistor 269 and resistor 269*a* to ground and is also connected to the output 267 of comparator 265 through a resistor 270. With comparator 265 turned on in response to a logic "1" signal at input 264, a logic "0" appears at output 267 and the reference voltage $V_r$ at input 268 decreases from a predetermined value $V_{r2}$ to a lower pre-determined value $V_{r1}$. The comparator 255 remains turned off until the drive unit 26' returns to the trimmed in thrust axis 33' and the trim position signal $V_p$ decreases.

When the trim position signal $V_p$ equals the reference voltage $V_{r1}$, which is substantially at the logic "0" level, the comparator 255 turns on and provides a logic "0" signal at output 259. The switching transistors 261 and 262 turn-off in response to the logic "0" at output 259 and operatively de-energize the in trim relay 38' by preventing operating power from flowing from battery 77 through diode 233 to the unregulated power source terminal 232, a connecting circuit 276, Darlington 262, and connecting circuit 243. With the switching transistors 261 and 262 turned off, the trim in command signal at 263 returns to a logic "0" and comparator 265 turns off. The reference voltage at input 268 increases to the pre-determined magnitude $V_{r2}$ with comparator 265 turned off.

The predetermined magnitude $V_{r2}$ of the reference voltage is established at the instant the trim position signal $V_p$ decreases to logic "0" and permits possible subsequent oscillations to occur in the trim position signal $V_p$ without activating the in trim relay 38'. The pre-determined magnitude $V_{r2}$ could, if desired, be set to permit deviations in the drive unit trim position of a pre-determined amount, such as four degrees from the trimmed-in thrust axis 33' for example.

The reference voltage $V_{r2}$ remains at the input 268 of comparator 255 while the drive unit 26' remains at or near the trimmed-in thrust axis 33' and operates to prevent undesirable oscillations and/or hunting in the trim in command circuit 241. For example, if the drive unit 26' rotates upwardly beyond the predetermined in trim limit i.e., to or beyond the four degree limit imposed by $V_{r2}$, the comparator 255 will turn off to provide a logic "1" at output 259. If the boat 21' is operated at low speed, the comparator 250 also provides a logic "1" signal at output 252 and the switching transistors 261 and 262 turn on to energize the in trim relay 38' to return the drive unit 26' to the in trim thrust axis 33'.

The trim position signal $V_p$ at lead 253 is also connected to the inverting input 249 of comparator 250 through a resistor 272. A non-inverting input 273 of comparator 250 is connected to the reference voltage $V_{cc}$ through a voltage divider 274 and to the output 252 through a feedback resistor 273*a*. The resistors 251 and 272 are selected so that the trim position signal $V_p$ has no significant effect upon the operation of comparator 250 during normal operations. If an open circuit occurs within the trim position sensor 39, a large voltage signal appears at the inverting input 249 of comparator 250 through the resistors 256 and 272. In such situation, the comparator 250 will turn on in response to the open circuit and provide a logic "0" signal at output 252 to turn off and disable the switching transistors 261 and 262 for maintaining the in trim relay 38' de-energized.

When the boat 21' operates at a higher speed, such as above 3100 RPM for example, the speed switch 52' provides a logic "1" disable signal to the input 249 and comparator 250 will turn on to provide a logic "0" at output 252 to disable the trim command 241 and maintain the in trim relay 38' de-energized to prevent the movement of the drive unit 26' to the in trim thrust axis 33'.

A reset control includes a resistor 275 connected across the emitter-collector circuit of Darlington 262 and also connects an unregulated power supply circuit 276 with the output circuit 243. Such reset control functions within the trim in command circuit 241 for operation at the trimmed-in thrust axis 33' when the system is transferred from manual to automatic control by the auto-manual control circuit 242. In manual control, the connecting circuit 243 is maintained in an open circuit condition and resistor 275 operatively establishes a logic "1" signal at the inverting input 264 of comparator 265. The comparator 265 thus remains turned on while the system is operated manually through the controller 242 and the trimmed-in reference signal $V_{r1}$ is applied to input 268 of comparator 255. When the system is transferred from manual to automatic control, the trim in command 241 is initially pre-conditioned or reset at the trimmed-in position through the maintenance of the reference signal $V_{r1}$ at input 268 of comparator 255.

Figure 14:
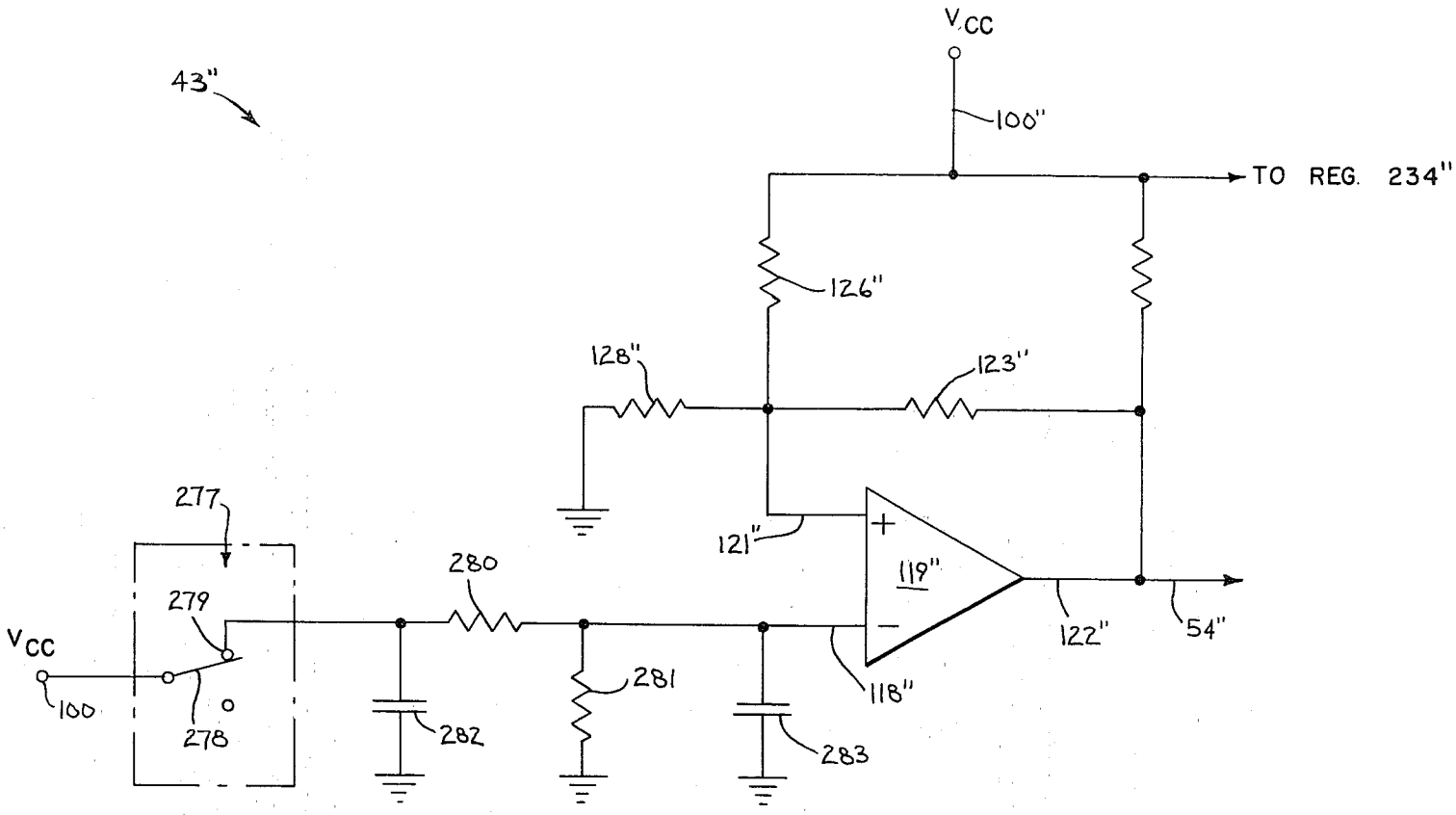
FIG. 14 is an alternative embodiment of an on-plane sensor for use in the electrical trim control of FIG. 1.

An alternative embodiment of an on-plane sensor 43'' is illustrated in FIG. 14. A pressure switch 277 senses the pressure of fluid opposing the movement of the boat 21. For example, switch 277 may be mounted to the hull 22 below the water line to sense water pressure or above the water line to sense air pressure in response to movement of the boat 21.

In any event, switch 277 provides a switch arm 278 which normally engages a contact 279 to complete an electrical circuit from the reference voltage circuit 100 to an inverting input 118'' of a comparator 119'' through a connecting resistor 280. The resistor 280 functions with a resistor 281 coupled to the system neutral to form a voltage divider while capacitors 282 and 283 couple transients to the system neutral.

When the boat 21 operates below a predetermined speed, the fluid pressure sensed by switch 277 is below a predetermined magnitude and the switch arm 278 remains engaged with contact 279 and comparator 118'' remains in a "turned on" condition to provide a logic "0" trim command signal at output 122'' and connecting circuit 54''.

When the boat 21 operates at or above a predetermined speed, the fluid pressure sensed by switch 277 is at or above a predetermined magnitude and the switch arm 278 is transferred out of engagement with contact 279. Thus when contact 279 is open-circuited, the comparator 118'' is "turned off" to provide a logic "1" trim command signal at output 122'' and connecting circuit 54'' to provide an auto-out trimming sequence as previously described.

When the boat slows down when operating at high speed so that its speed decreases below the predetermined speed, the fluid pressure sensed by switch 277 correspondingly decreases below the predetermined magnitude and switch arm 278 transfers to engage contact 279. When switch arm 278 engages contact 279, comparator 118 "turns on" to provide a logic "0" trim command signal at output 122'' and connecting circuit 54'' to provide an in-trimming sequence as previously described.

Figure 15:
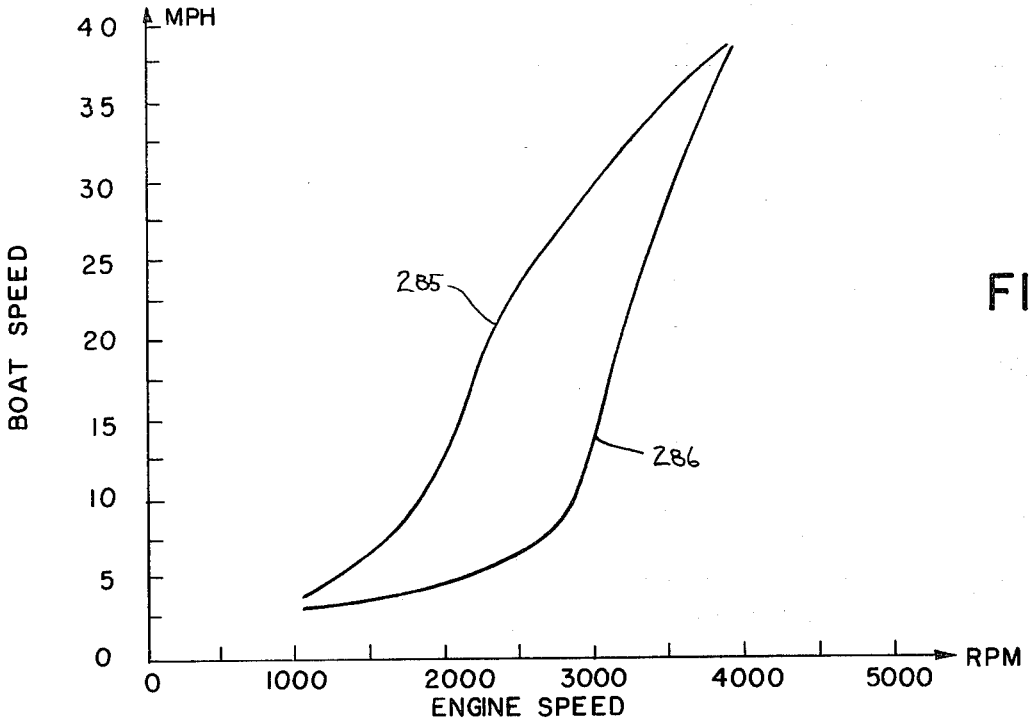
FIG. 15 is a boat speed versus engine speed graph showing the relationship between engine speed in revolutions per minute and actual boat speed for a given boat construction and operation.

FIG. 15 illustrates the relationship between boat speed and engine speed during normal operations for a given boat construction. The region between curves 285 and 286 describe a range of boat operation between steady-state operation or zero acceleration and full throttle acceleration.

Figure 16:
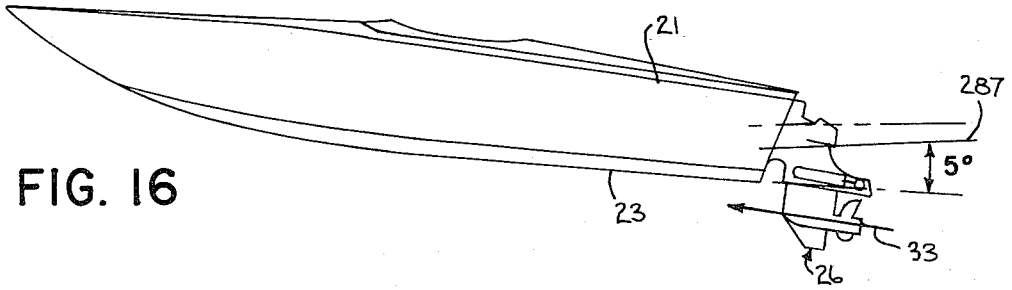
Figure 17:
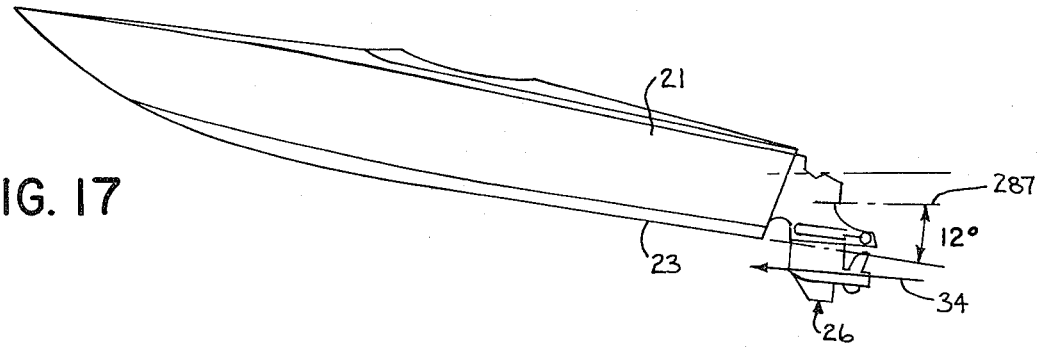
FIG. 17 is a side elevational view of an operating boat in water and illustrates a low speed operation with the drive unit trimmed-out.
Figure 18:
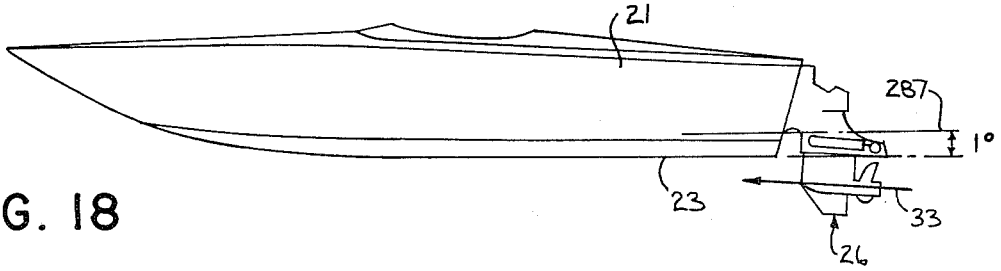
Figure 19:
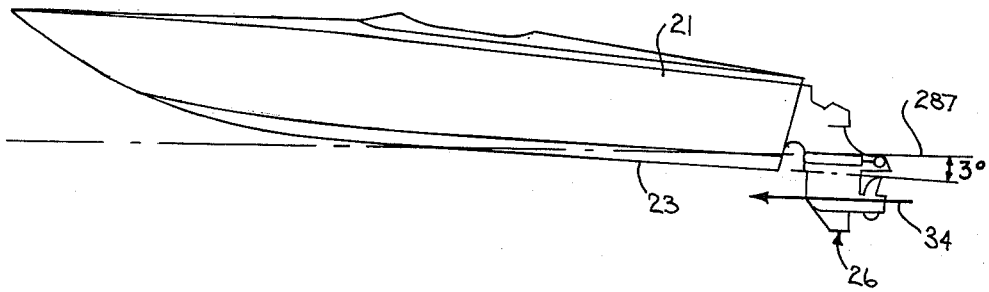
FIG. 19 is a side elevational view of an operating boat in water and illustrating a high speed operation with the drive unit trimmed-out.

FIGS. 16–19 represent various operating conditions of the boat 21 and illustrate the boat angle of attack measured by the relationship of the keel 23 to the quiescent or average water surface illustrated at 287. In FIG. 16, the drive-unit 26 is at the trimmed-in thrust axis 33 and the boat 21 is operating at a low speed, i.e. such as under 3100 RPM for example, with an approximate five degree angle of attack between keel 23 and the water surface 287. In FIG. 17, the drive unit 26 is at the auto-out thrust axis 34 and the boat 21 is operating at a low speed, such as below 3100 RPM for example, with an angle of attack of approximately twelve degrees between keel 23 and the water surface 287. In FIG. 18, the drive unit 26 is at the trimmed-in thrust axis 33 and the boat 21 is operating at a high speed, such as above 3100 RPM for example, with an angle of attack of approximately one degree between the keel 23 and the water surface 287. In FIG. 19, the drive unit 26 is at the auto-out thrust axis 34 and the boat 21 is operated at a high speed, such as above 3100 RPM for example, with an angle of attack of approximately three degrees.

Figure 20:
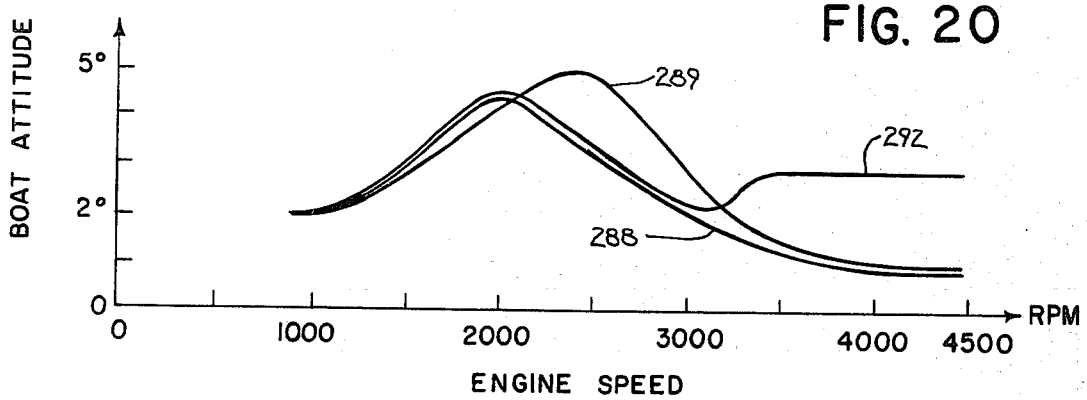
FIG. 20 is a boat attitude versus engine speed graph illustrating two trimmed-in sequences of operation in comparison with the operation under the trim control of FIG. 1.

FIG. 20 shows the relationship between the angle of attack and engine speed for different conditions of operation. An excessively low angle of attack, such as below two degrees for example, between the keel 23 and water surface 287 produces an excessive and undesirable friction drag (viscous shear drag) upon the hull of boat 21 when operating at high speed. For example, the response 288 illustrates a moderate acceleration of boat 21 with the drive unit 26 maintained at the trimmed-in thrust axis 33. As the engine speed increases above about 3000 RPM, the angle of attack decreases below two degrees and excessive drag is experienced as illustrated in FIG. 18 and by the response 288 in FIG. 20. The response 289 illustrates a similar operation at the trimmed-in thrust axis 33 under full throttle deceleration where the angle of attack decreases below two degrees at engine speeds of about 3200 RPM.

Figure 21:
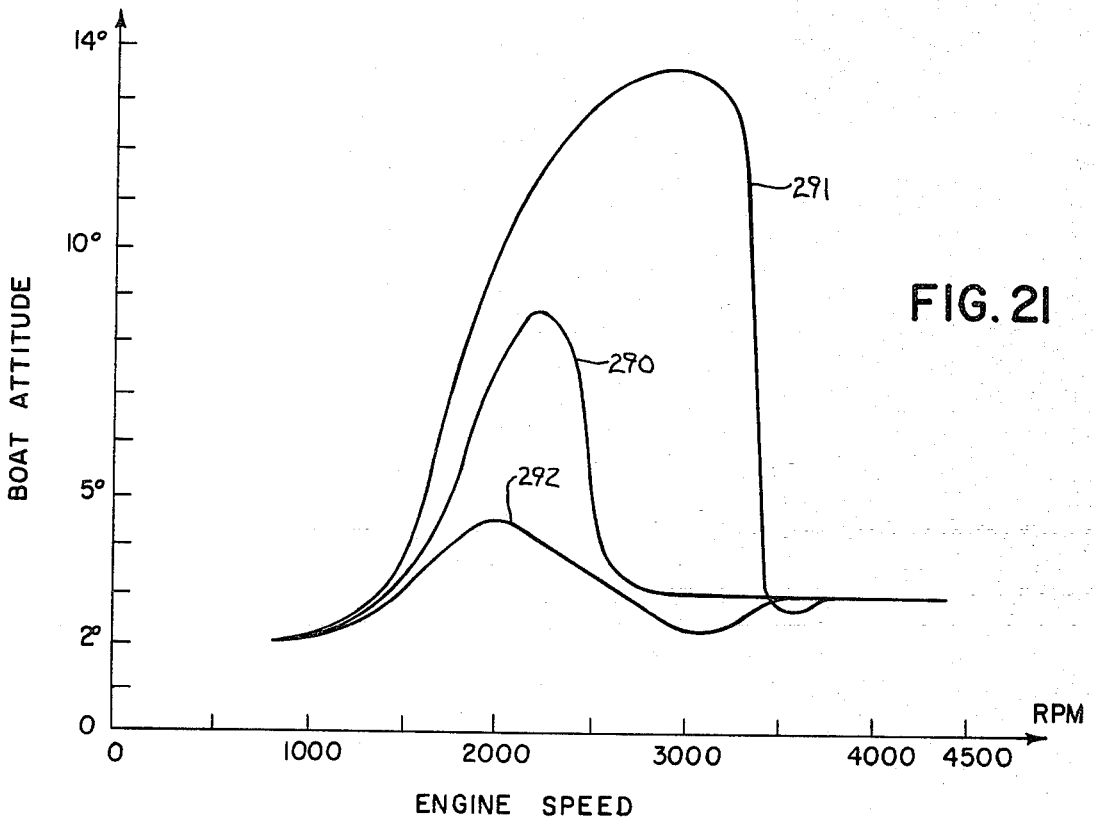
FIG. 21 is a boat attitude versus engine speed graph illustrating two trimmed-out sequences of operation in comparison with the operation under the trim control of FIG. 1.

FIG. 21 also shows the relationship between the angle of attack and engine speed for different conditions of operation. Excessively high angles of attack, such as above five degrees for example, between the keel 23 and water surface 287 produces an excessive and undesirable drag (form drag) upon the hull of boat 21 when operating at low speed. For example, the response 290 illustrates a deceleration of boat 21 with the drive unit 26 maintained at the auto-out thrust axis 34. When the engine speed is approximately between 1700 RPM and 2500 RPM, the angle of attack increases above five degrees and excessive form drag (pressure drag) is experienced as illustrated in FIG. 17 and the response 290 in FIG. 21. The response 291 in FIG. 21 illustrates a similar operation at the auto-out thrust axis 34 under full throttle acceleration where the angle of attack increases above five degrees when the engine speed is approximately between 1600 RPM and 3400 RPM.

The wave form or response 292 in FIGS. 20 and 21 represents a moderate acceleration of boat 21 operating under the automatic trim control of the invention. When the engine speed increases to approximately 3100 RPM, the trim out command actuates the out trim relay and transfers the drive unit 26 from the in trim thrust axis 33 to the auto-out thrust axis 34. In such automatic trim operation, the boat 21 accelerates at the trimmed-in thrust axis 33 at low engine speeds, such as below 3100 RPM for example as illustrated in FIG. 16, and transfers to accelerate at the auto-out thrust axis 34 at high engine speeds, such as above 3100 RPM for example as illustrated in FIG. 19. During such accelerating sequence, the angle of attack varies well within the two degree to five degree constraints and substantially reduced drag is experienced during the engine speed range of 1000 RPM to 4000 RPM. When decelerating from a high speed, the boat 21 initially decelerates at the auto-out thrust axis 34 at high engine speeds, such as above 2600 RPM for example, and transfers to decelerate at the trimmed-in thrust axis 33 at low engine speeds, such as below 2600 RPM for example.

With the system constructed to operate in accordance with either of the embodiments of FIGS. 3–6 or FIGS. 12–13, the first predetermined magnitude speed for transferring from the trimmed-in thrust axis 33 to the auto-out thrust axis 34 is preselected according to the operating characteristics of the boat 21 so as to correspond to the transfer of the boat 21 from an off-plane condition to an on-plane condition. In other words, the first predetermined speed is established at or shortly after the boat 21 transfers from an off-plane to an on-plane condition. In similar manner, the second predetermined magnitude speed for transferring from the auto-out thrust axis 34 to the trimmed-in thrust axis 33 is pre-selected so as to correspond to the transfer of the boat from an on-plane condition to an off-plane condition. In other words, the second pre-selected predetermined speed is established at or shortly after the boat 21 transfers from an on-plane to an off-plane condition. It is understood that such predetermined speeds will vary from boat to boat depending upon its mass, hull configuration, propeller thrust and many other factors which influence boat operation.

When operating with the embodiment of FIG. 14, the predetermined magnitude sensed pressure for transferring between the trimmed-in thrust axis 33 and the auto-out thrust axis 34 is pre-selected to substantially correspond to the transfer of the boat 21 between the off-plane condition and the on-plane condition.

While it is possible to initiate a trimming-out sequence immediately in response to the second output from the speed switch 52, the trim out delay 55 illustrated in FIGS. 3–6 has been found to be necessary under some conditions such as heavy boat loading. This delay permits the boat 21 to "plane" on the water surface before the drive unit 26 is transferred to the auto-out thrust axis 34.

The auto-trim control accurately senses an on-plane and an off-plane condition to vary the drive-thrust axis to maintain a proper angle of attack between the boat keel and the water to substantially reduce hydrodynamic drag and provide efficient operation with improved handling control.

We claim:

1. An apparatus to trim a marine propulsion unit within a marine transportation system including a boat having an engine and a trimmable drive, comprising sensing means operating independently of the attitude of said boat to monitor the operation of said marine transportation system to provide an output distinguishing a boat operation in an off-plane condition and a boat operation in an on-plane condition, and drive trimming means operable by said sensing means to position said drive at a desired trim position in response to said sensing means output.

2. The apparatus of claim 1, wherein said sensing means provides a first output in response to a sensed off-plane condition and a second output in response to a sensed on-plane condition, said drive trimming means operating to a first trim position in response to said first output and operating to a second trim position different than said first trim position in response to said second output.

3. The apparatus of claim 1, wherein said sensing means includes a sensor to sense the operating speed of said engine to provide said distinguishing output.

4. The apparatus of claim 1, wherein said sensing means includes a sensor to sense the fluid pressure opposing the movement of said boat to provide said distinguishing output.

5. An apparatus to trim a marine propulsion unit within a marine transportation system including a boat having an engine and a trimmable drive, comprising speed sensing means monitoring the operation of said marine transportation system to provide a speed indicative output which is a function of sensed operating speed, and drive trimming means operable by said speed sensing means to position said drive at a desired trim position in response to said speed indicative output.

6. The apparatus of claim 5, wherein said speed sensing means provides a first speed output indicative of a first operating speed and a second speed output indicative of a second operating speed different than said first speed, said drive trimming means operating in response to said first speed output to transfer said drive to a first trim position and operating in response to said second speed output to transfer said drive to a second trim position.

7. An apparatus to trim a marine propulsion unit within a marine transportation system including a boat having an engine and a trimmable drive, comprising speed sensing means including a monitor providing a speed signal indicative of the speed of at least some operating portion of said marine system, a speed responsive switch providing a speed indicative output and operable from a first output to a second output in response to said speed signal having a first magnitude and operable from said second output to said first output in response to said speed signal having a second magnitude different than said first magnitude, and drive trimming means operable in response to said second output to operate said drive at a first trim position and operable in response to said first output to operate said drive at a second trim position different than said first trim position.

8. The apparatus of claim 5, wherein said speed sensing means includes a monitor providing a series of electrical pulses varying in accordance to the speed of at least some operating portion of said marine system for providing said speed indicative output to position said drive at a desired trim position.

9. The apparatus of claim 5, wherein said speed sensing means includes a monitor connected to said engine to detect engine speed.

10. An apparatus to trim a marine propulsion unit within a marine transportation system including a boat having an engine and a trimmable drive, comprising speed sensing means including a monitor providing a series of electrical pulses varying in accordance to the speed of at least some operating portion of said marine system, a pulse forming circuit operating in response to said speed varying pulses and providing a series of corresponding pulses each of constant magnitude and pulse-width, an integrator operating in response to said series of constant pulse-width pulses and providing a varying D.C. speed responsive signal inversely proportional to the frequency of said constant pulse-width pulses, a speed responsive switch continuously comparing said speed responsive signal with a reference signal and providing a speed indicative output, and drive trimming means operable by said speed sensing means to position said drive at a desired trim position in response to said speed indicative output.

11. The apparatus of claim 10, wherein said speed responsive switch compares said speed responsive signal with a first magnitude reference signal when said marine system operates at a low speed to provide a first speed indicative output and compares said speed responsive signal with a second magnitude reference signal when said marine system operates at a high speed to provide a second speed indicative output different than said first speed indicative output.

12. The apparatus of claim 5, wherein said drive trimming means includes a control to operatively transfer said drive from an in trim position to an out trim position in response to a predetermined speed indicative output signifying a high speed operation.

13. The apparatus of claim 12, wherein said control includes trim sensing means to detect said drive at said out trim position to terminate the transfer of said drive.

14. An apparatus to trim a marine propulsion unit within a marine transportation system including a boat having an engine and a trimmable drive, comprising speed sensing means monitoring the operation of said marine transportation system to provide a speed indicative output, and drive trimming means operable by said speed sensing means to position said drive at a desired trim position in response to said speed indicative output and including a control to operatively transfer said drive from an in trim position to an out trim position in response to a predetermined speed indicative output signifying a high speed operation and having delay means operating to initiate transfer of said drive from said in trim position to said out trim position at a predetermined time following the initiation of said high speed operation.

15. An apparatus to trim a marine propulsion unit within a marine transportation system including a boat having an engine and a trimmable drive, comprising speed sensing means monitoring the operation of said marine transportation system to provide a speed indicative output, and drive trimming means operable by said speed sensing means to position said drive at a desired trim position in response to said speed indicative output and including a control to operatively transfer said drive from an in trim position to an out trim position in response to a predetermined speed indicative output signifying a high speed operation and having disable means to prevent the transfer to said in trim position in response to said predetermined speed indicative output signifying a high speed operation.

16. The apparatus of claim 5, wherein said drive trimming means includes a control to operatively transfer said drive from an out trim position to an in trim position in response to a predetermined speed indicative output signifying a low speed operation.

17. An apparatus to trim a marine propulsion unit within a marine transportation system including a boat having an engine and a trimmable drive, comprising speed sensing means monitoring the operation of said marine transportation system to provide a speed indicative output, and drive trimming means operable by said speed sensing means to position said drive at a desired trim position in response to said speed indicative output and including a control to operatively transfer said drive from an out trim position to an in trim position in response to a predetermined speed indicative output signifying a low speed operation and having timing means operating to terminate the movement of said drive to said in trim position in response to the expiration of a predetermined time.

18. The apparatus of claim 17, wherein said control includes trim sensing means to detect said drive departing said out trim position toward said in trim position to initiate a timing sequence of said timing means.

19. The apparatus of claim 17, wherein said timing means responds to the initiation of said low speed operation to initiate a timing sequence of said timing means.

20. An apparatus to trim a marine propulsion unit within a marine transportation system including a boat having an engine and a trimmable drive, comprising speed sensing means monitoring the operation of said marine transportation system to provide a speed indicative output, and drive trimming means operable by said speed sensing means to position said drive at a desired trim position in response to said speed indicative output and including a control to operatively transfer said drive from an out trim position to an in trim position in response to a predetermined speed indicative output signifying a low speed operation and having disable means to prevent the transfer to said out trim position in response to said predetermined speed indicative output signifying a low speed operation.

21. The apparatus of claim 5, wherein said drive trimming means includes a control to operatively transfer said drive in response to said speed indicative output and includes trim sensing means monitoring the position of said drive to provide a trim position signal representing the position of said drive, said control terminating the movement of said drive in response to said trim position signal attaining a predetermined magnitude representing the drive at a predetermined position.

22. The apparatus of claim 21, wherein said control operates in response to said trim position signal attaining a second predetermined magnitude representing the drive at a second predetermined position different than said first mentioned position to move said drive to said first position.

23. An apparatus to trim a marine propulsion unit within a marine transportation system including a boat having an engine and a trimmable drive, comprising engine speed sensing means to detect engine speed, trim sensing means to detect the position of said drive, and drive trimming means operable by said speed sensing means and said trim sensing means to position said drive at a desired trim position in response to the sensed engine speed and trim position.

24. The apparatus of claim 23, wherein said drive trimming means includes control means to compare said detected drive position to a predetermined drive position for a given engine speed to move said drive unit to said predetermined position.

25. A trim control to trim a marine propulsion unit of a boat having an engine and a trimmable drive comprising engine speed sensing means to detect engine speed, and drive trimming means operable by said engine speed sensing means to move said drive to an out trim position in response to a sensed high engine speed and to move said drive to an in trim position in response to a sensed low engine speed.

26. An apparatus to trim a marine propulsion unit of a boat having an engine and a trimmable drive, comprising a hydraulic apparatus including a reversible electro-hydraulic pump connected to move the trimmable drive, an in trim electric relay connected to operate the hydraulic apparatus to move the trimmable drive to an in trim position, an out trim electric relay connected to operate the hydraulic apparatus to move the trimmable drive to an out trim position, a monitoring circuit connected to said engine to provide a series of pulses which vary in number per unit time in response to engine speed, a mono-stable multi-vibrator responsive to said series of pulses to produce a series of corresponding pulses each of constant magnitude and pulse width, an integrator responsive to said series of constant pulse-width pulses and providing a varying D.C. speed responsive output inversely proportional to the frequency of said constant pulse-width pulses and indicative of engine speed, a speed responsive switch to compare the varying D.C. speed responsive output with a first magnitude speed reference signal to transfer from a first output to a second output when the D.C. speed responsive output equals the first magnitude speed reference signal at a first magnitude engine speed and to compare the varying D.C. speed responsive output with a second magnitude speed reference signal to transfer from said second output to said first output when the D.C. speed responsive output equals the second magnitude speed reference signal at a second magnitude engine speed different than said first magnitude speed, and means responding to said first and second outputs to activate said out trim relay in response to said second output to provide a trimming-out sequence and to activate said in trim relay in response to said first output to provide a trimming-in sequence.

27. The apparatus of claim 26, wherein said responding means includes a first timing circuit connected to said speed responsive switch and providing a delayed out trim signal after a predetermined time in response to the transfer from said first output to said second output, a trim out control responsive to said delayed out trim signal to provide an out trim energizing signal to said out trim relay to move the trimmable drive to the out trim position, a limit switch sensing the position of said trimmable drive and connected in circuit with said out trim relay to de-energize the out trim relay when the trimmable drive is at the out trim position, a trim in control responsive to said first output to provide an in trim energizing signal to said in trim relay to move the trimmable drive to the in trim position, an auto-manual control operatively connected to said trim in and trim out controls and to said in trim and out trim relays and selectively operable between a first operating position to manually control the energization of said in trim and out trim relays and a second operating position to automatically control the energization of said in trim and out trim relays by the operation of said trim in and trim out controls, a trim out monitor connected to said trim out control and to said limit switch and providing a trimmed-in signal in response to the trimmable drive at the in trim position, an auto-manual sensor connected to said auto-manual control and providing an auto operation signal in response to said second operating condition, a second timing circuit operating in response to said trimmed-in signal, trim-out signal, trim limit sensor signal and said auto operation signal and providing a first trim in disable signal after a first predetermined trim in period, and a third timing circuit operating in response to said in trim energizing signal and auto-manual sensor and providing a second trim in disable signal after a second predetermined trim in period longer than said first period, said trim in control responsive to one of said first and second disable signals to de-energize the in trim relay and terminate the in trim sequence.

28. The apparatus of claim 26, wherein said responding means includes a trim out control responsive to said second output to energize said out trim relay to move the trimmable drive to the out trim position, a limit switch monitoring the position of said trimmable drive and connected in circuit with said out trim relay to de-energize the out trim relay when the trimmable drive is at the out trim position, a drive sensor monitoring said trimmable drive to provide a drive position signal representing the position of said drive, a trim in control responsive to said first output to energize said in trim relay to move the trimmable drive to the in trim position and responsive to said drive position signal representing that said drive is at the in trim position to de-energize the in trim relay, said trim in control providing an in trim monitor responsive to the de-energization of said in trim relay and said drive position signal to energize said in trim relay when said drive moves a predetermined distance from the in trim position and said boat is operating below said second magnitude engine speed.

* * * * *